US008465357B2

(12) United States Patent
Bryant et al.

(10) Patent No.: US 8,465,357 B2
(45) **Date of Patent: *Jun. 18, 2013**

(54) GAMING MACHINE WITH BUY FEATURE GAMES

(71) Applicants: Natalie Bryant, Lane Cove (AU); Nicholas Luke Bennett, Lane Cove (AU)

(72) Inventors: Natalie Bryant, Lane Cove (AU); Nicholas Luke Bennett, Lane Cove (AU)

(73) Assignee: Aristocrat Technologies Austrialia Pty Ltd (AU)

( * ) Notice: Subject to any disclaimer, the term of this patent is extended or adjusted under 35 U.S.C. 154(b) by 0 days.

This patent is subject to a terminal disclaimer.

(21) Appl. No.: 13/692,659

(22) Filed: Dec. 3, 2012

(65) Prior Publication Data

US 2013/0090154 A1 Apr. 11, 2013

Related U.S. Application Data

(63) Continuation of application No. 13/015,752, filed on Jan. 28, 2011, which is a continuation of application No. 12/018,605, filed on Jan. 23, 2008, now Pat. No. 8,038,524, which is a continuation of application No. 10/070,266, filed on Jul. 19, 2002, now abandoned.

(30) Foreign Application Priority Data

Aug. 25, 1999 (AU) ..... PQ2428
Aug. 23, 2000 (WO) ..... PCT/AU00/00997

(51) Int. Cl.
*A63F 9/24* (2006.01)

(52) U.S. Cl.
USPC ..... 463/16; 463/20

(58) Field of Classification Search
USPC ..... 463/16, 20
See application file for complete search history.

(56) References Cited

U.S. PATENT DOCUMENTS

| | | | | |
|---|---|---|---|---|
| 5,704,835 | A * | 1/1998 | Dietz, II | 463/20 |
| 5,830,063 | A * | 11/1998 | Byrne | 463/18 |
| 5,868,619 | A * | 2/1999 | Wood et al. | 463/13 |
| 5,935,002 | A * | 8/1999 | Falciglia | 463/19 |
| 6,017,032 | A * | 1/2000 | Grippo et al. | 273/138.1 |
| 6,315,660 | B1 * | 11/2001 | DeMar et al. | 463/16 |
| 7,419,429 | B2 * | 9/2008 | Taylor | 463/25 |

* cited by examiner

*Primary Examiner* — Corbett B Coburn
(74) *Attorney, Agent, or Firm* — McAndrews, Held & Malloy, Ltd.

(57) ABSTRACT

A gaming machine including a display. The display includes a plurality of display positions for displaying combinations of symbols. A controller controls operation of the machine. The controller includes a processor for processing data and displaying selected data on the display. A selector is operable by the player of the machine for enabling the player to select at least one feature which can be added to a base game played on the machine.

16 Claims, 9 Drawing Sheets

GAMING MACHINE WITH BUY FEATURE GAMES

RELATED APPLICATIONS

This application claims priority to, and is a continuation of, co-pending U.S. patent application Ser. No. 13/015,752, filed on Jan. 28, 2011, which is a continuation of U.S. application Ser. No. 12/018,605, having a filing date of Jan. 23, 2008 and which issued on Oct. 18, 2011 as U.S. Pat. No. 8,038,524, which claims priority to, and is a continuation of, U.S. patent application Ser. No. 10/070,266, now abandoned, having a filing date of Jul. 19, 2002, which claims priority to International Application PCT/AU00/00997, filed on Aug. 23, 2000, which in turn claims priority to Australian Application No. PQ 2428, filed on Aug. 25, 1999, each of which is also incorporated herein by reference in its entirety.

FEDERALLY SPONSORED RESEARCH OR DEVELOPMENT

Not Applicable

MICROFICHE/COPYRIGHT REFERENCE

Not Applicable

BACKGROUND OF THE INVENTION

The present invention relates to a gaming machine. More particularly, the invention relates to a gaming machine of the type known as a slot machine or a fruit machine. Certain types of these machines have a series of rotatable reels, each of which displays a series of symbols or a video simulation of such a mechanism while other types of machines are arranged to play video simulations of card games or other types of wagering games, such as bingo or keno. The invention has particular application to an improved game played on such a machine.

Players regularly playing gaming machines need to have their interests maintained. Therefore, it is necessary for manufacturers of these machines to develop inventive game features which add interest to the games provided on such machines in order to keep the players entertained and willing to continue to play the games.

There is a continuous trade-off between what the players of the machines want and what the operators of the machines want from the machines. Naturally, operators want the players to stake more money per game so that the overall turnover is higher. Conversely, players will not do this unless they feel that they are getting more for the extra money that they are betting.

Further, as the range of machines and games increases, it is becoming increasingly important to offer more options to the players. The more options that are available in one machine, the easier it is to maintain the player's interest and the easier it is for players to be able to gain access to a machine that will offer them exactly the game that they want.

To date, most types of video gaming machines which are available to players offer limited options. At best, a range of bet sizes and paylines upon which the players can bet are offered. Certain machines also offer a double-up option available after a win while other machines have various ranges of paytables particularly for higher bets.

BRIEF SUMMARY OF THE INVENTION

According to the invention there is provided a gaming machine which includes:

a display means including a plurality of display positions for displaying combinations of symbols;

a control means for controlling operation of the machine, the control means including a processing means for processing data and displaying selected data on the display means; and a selecting means operable by a player of the machine for enabling the player to select at least one feature which can be added to a base game played on the machine.

The base game may have no features at all. For example, in the case of a video simulation of a spinning reel game, there would be no scatter symbol or substitute symbol or feature triggered by the occurrence of a predetermined or random event. Instead, by means of the selecting means, the player may be able to select at least one and, preferably, a range of features that can be added to the base game to tailor the base game to the player's requirements. Various features may be offered. For example, certain symbols may be selected to pay as scatter symbols or substitute symbols as well as or in addition to the standard pays. Other examples include additional types of pays, for example, right to left as well as the basic left to right pay or bonus features such as free games, bonus pays, etc which are triggered by certain combinations.

Certain features may be offered as no-cost features which are selected by the player by means of the selecting means. Other features may have a cost associated therewith a player having to stake additional credit to obtain the feature or eligibility to the feature. If desired, the bet to obtain one or more features may be independent of the type or size of bet made on the base game. Thus, it is not necessary for the maximum bet to be placed on the base game before access can be gained to the range of features. In addition, the cost for the various features may differ depending on the type of feature or range of features selected.

In one embodiment of the invention, where only one additional feature or a range of the same type of feature is offered, the additional credit staked by the player may be a multiple of a base bet wagered by the player. Different multiples of the base bet may purchase different features of that type. For example, a bet×2 feature may purchase two free spins, a bet×3 feature may purchase four free spins and bet×4 feature may purchase six free spins.

The selecting means may include a plurality of selectors, such as buttons on the midtrim, operable by the player to select the feature required before making the base bet. One of the buttons may be used by the player when only the base bet is to be staked.

Only one feature, if any, at a time may be selectable by the player by means of the selectors. For example, a standard bet with no additional feature may be wagered, or a bet with only one type of feature may be wagered.

The additional credit staked may only provide eligibility to a benefit provided by that feature, there being no guarantee that the feature will eventuate merely by having staked the additional credit. Hence, the player will not necessarily see a direct result of the extra stake for every game played. For example, a predetermined combination may need to appear to trigger the special feature (e.g. free spins) or to pay a bonus prize (egg a right to left pay).

In another embodiment of the invention, the additional credit staked may be a fixed amount multiplied by a bet wagered per line (for a spinning reel game) or per draw (for a card game).

The feature for which the additional credit is staked may be triggered independently of the base game. In other words, a random selection is made by the control means as to whether or not to trigger the feature completely independently of the base game.

Further, the gaming machine may be a multi-game machine having various games. Then, the appropriate game may initially be chosen and, thereafter, the required feature or features for the game may be selected by the player.

The selecting means may include dedicated keys or buttons on a keypad of the gaming machine and/or a touch or interactive screen of the display mean for enabling the features and/or games to be selected.

BRIEF DESCRIPTION OF SEVERAL VIEWS OF THE DRAWINGS

The invention is now described by way of example with reference to the accompanying diagrammatic drawings in which.

DETAILED DESCRIPTION OF THE DRAWINGS

Figure 1:
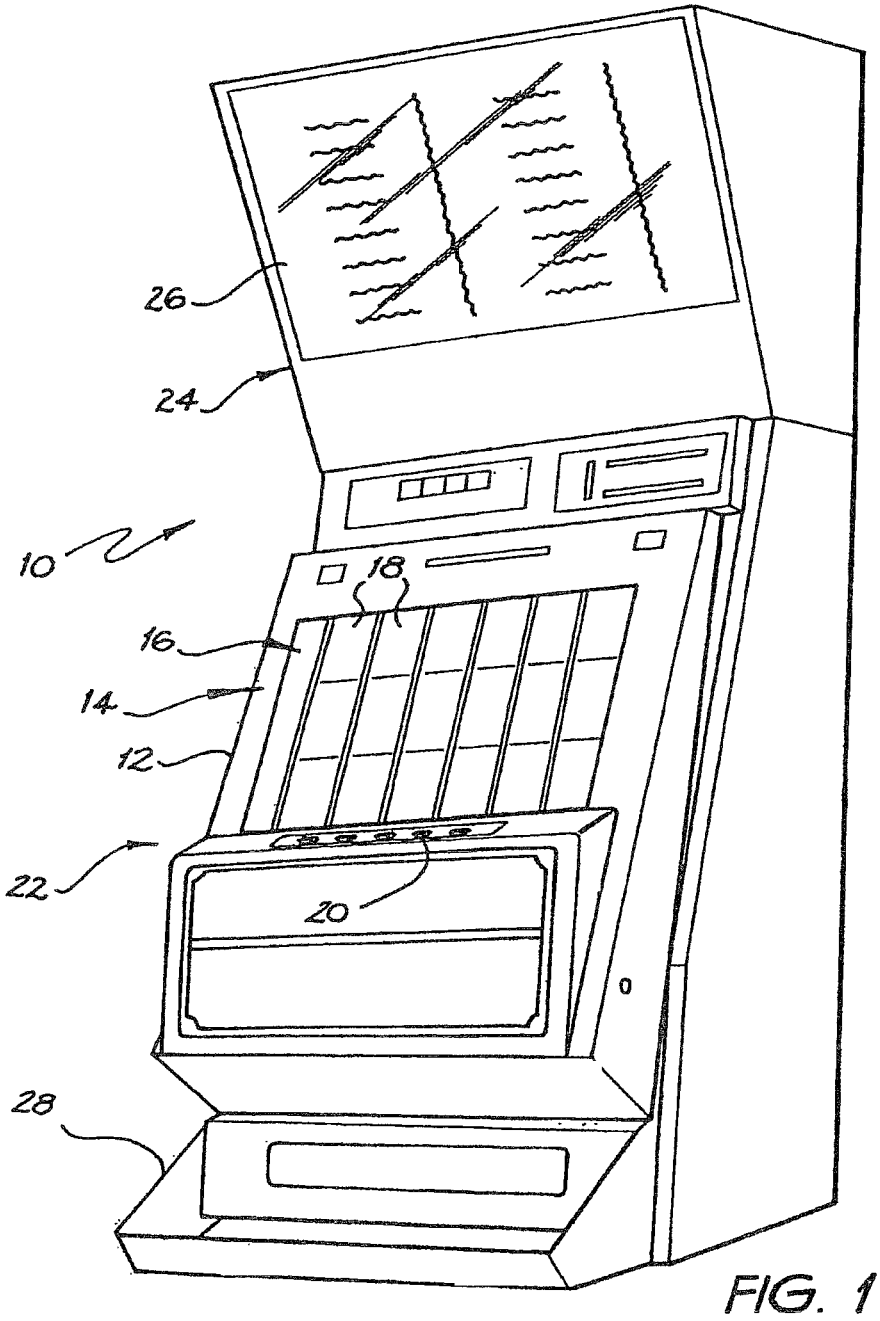
FIG. 1 shows a three dimensional view a gaming machine.

In FIG. 1, reference numeral 10 generally designates a gaming machine, including a game, in accordance with the invention. The machine 10 includes a gaming console 12 having a video display unit 14. The video display unit includes a screen 16 on which reels 18 are simulated. A keypad 20, which is shown in greater detail in FIG. 3 of the drawings, is mounted on a midtrim 22 of the machine 10.

The machine includes a topbox 24 on which a paytable 26 is arranged.

Figure 2:
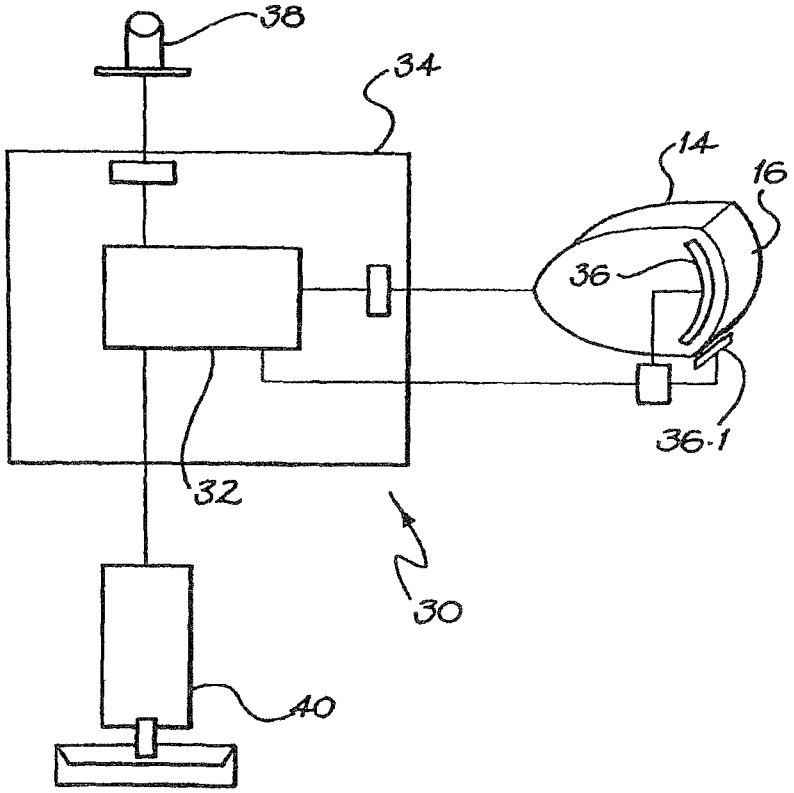
FIG. 2 shows a block diagram of a control means of the gaming machine.

Referring now to FIG. 2 of the drawings, a control means 30 of the machine 10 is illustrated. A program which implements the game and user interface is run on a processor 32 of the control means 30. The processor 32 . . . forms part of a controller 34 which drives the screen 16 of the video display unit 14. The processor 32 receives input signals from a first group of sensors 36.1 which are responsive to keys of the keypad 20. A second group of sensors 36.2 are touch sensors associated with the screen 16 of the video display unit 14.

The controller 34 also receives input pulses from a mechanism 38 indicating that a player has provided sufficient credit to begin playing. The mechanism 38 may be a coin input chute, a bill collector, a credit card reader, any other type of validation device, or a combination thereof.

The controller 34 also controls a payout mechanism 40 which, for example, may be a coin hopper for feeding coins to a coin tray 28 of the machine 10.

With the game of the gaming machine 10, a player playing the machine 10 has the option to make a bet that is a multiple of a base bet to buy an additional feature to the game. The additional bet need not be a multiple of the specified maximum bet of the machine 10. Thus, the player is allowed to, for example, double or treble their initial bet to be eligible for an additional game feature. In this way, even players who bet a single credit on one line (on a multi-line game), are eligible to buy features, by doubling or trebling their bets.

The extra bet that the player is required to make does not make any change to the game the player has bought other than to introduce eligibility to the feature. In other words, no additional pay lines are bought or linear increases made to the pay table as the extra bet is a dedicated bet towards the feature.

Figure 3:
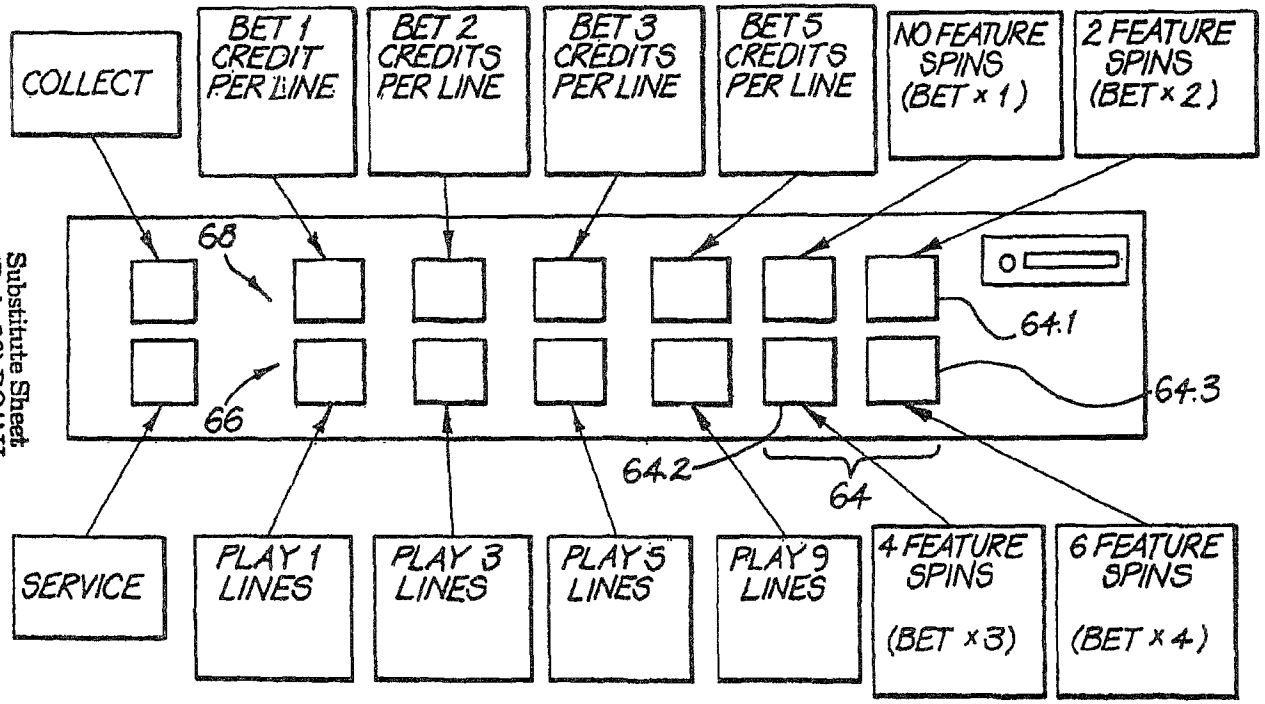
FIG. 3 shows a schematic plan representation of one embodiment of a keypad of the gaming machine.

Referring now to FIG. 3 of the drawings a modified keypad 20 for the machine is shown. Instead of, or in addition, to the touch screen facility in the screen 16 of the video display unit 14 of the machine 10, dedicated buttons 64 are provided on the keypad 20.

The keypad 20 has a conventional array of buttons 66 for enabling the player to select the number of lines of the machine on which to achieve a payout as well as a conventional array of buttons 68 for enabling the player to select the number of credits to be bet per line.

A "base bet" is represented by the buttons 68 labelled "Bet×credits per line" and the buttons 66 labelled "Play× lines". The feature of the game is that if a player stakes double the base bet by means of button 64.1 then, whenever a specified combination of symbols is spun up, certain reel positions will be held while the rest of the reels are spun again twice for free. For triple the base bet (button 64.2) the same combination would result in four free spins and for quadruple the base bet (button 64.3) there would be six free spins. Thus, if the player is betting two credits per line on five lines then the base bet will be ten credits. If the player chooses to buy access to the four free spins feature by selecting the "four feature spins (bet×3)" button 64.2 then a game will cost the player thirty credits. The payline prizes will still only be multiplied by the player's bet per line of two credits, and prize combinations will still only apply on the five lines that have been bought. However, the additional feature of a specified combination of symbols awarding four re-spins of some of the reels will apply. Accordingly, it will be noted that only the base bet or the base bet plus the additional credit for one type of feature may be wagered at any one time. Also, the mere wagering of the additional credit does not guarantee that the feature will occur. The wagering of the additional credit only provides eligibility for the applicable feature.

It will be appreciated that various other options could be provided by means of the appropriate number of buttons 64 on the keypad 20.

In this embodiment, other examples which are possible are, inter alia, the additional feature may be the purchase of a certain combination which, if obtained, will commence a free game series. Instead, an additional feature trigger symbol may be purchased so that, in addition to an original trigger symbol, the additional trigger symbol also provides a free spin feature. Yet further, a right-to-left payout feature, in addition to the more conventional left-to-right payout can be bought.

Figure 4:
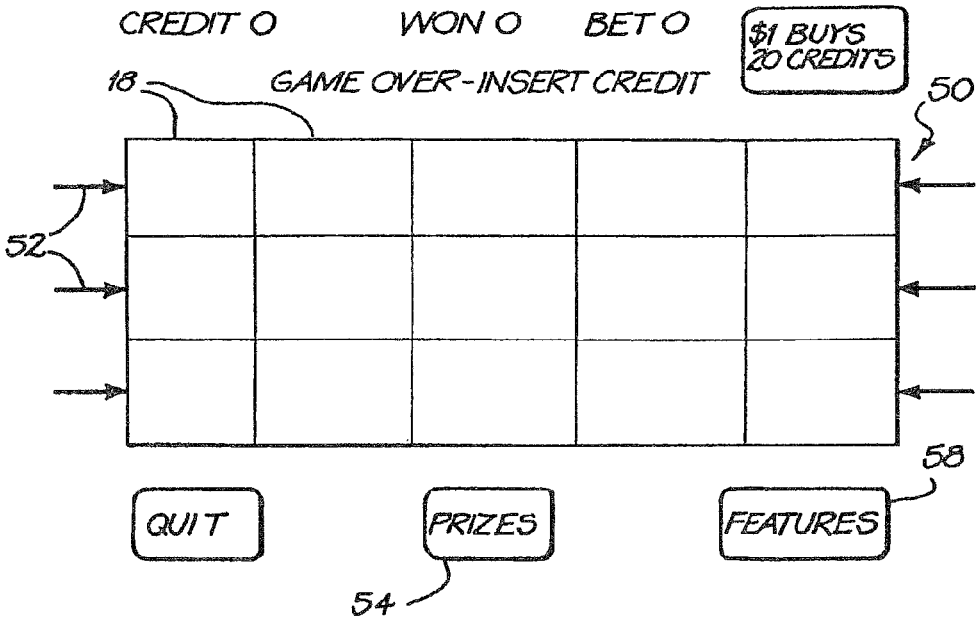
FIG. 4 shows a schematic representation of a first screen of the gaming machine.
Figure 5:
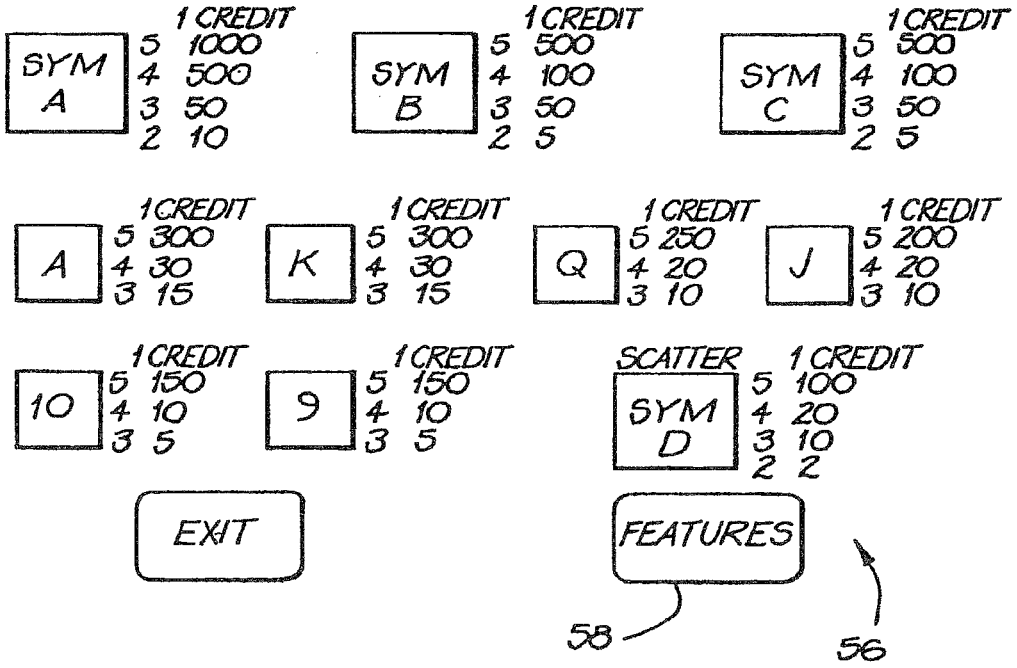
FIG. 5 shows a schematic representation of a second screen of the gaming machine.
Figure 6:
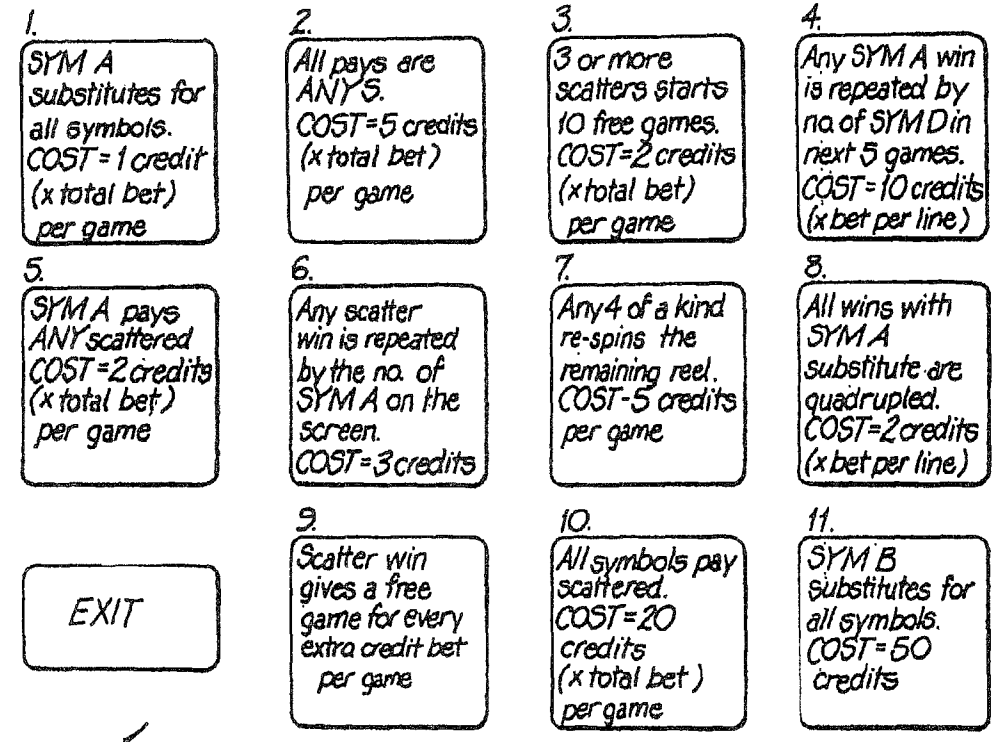
FIG. 6 shows a schematic representation of one embodiment of a third screen of the gaming machine.
Figure 7:
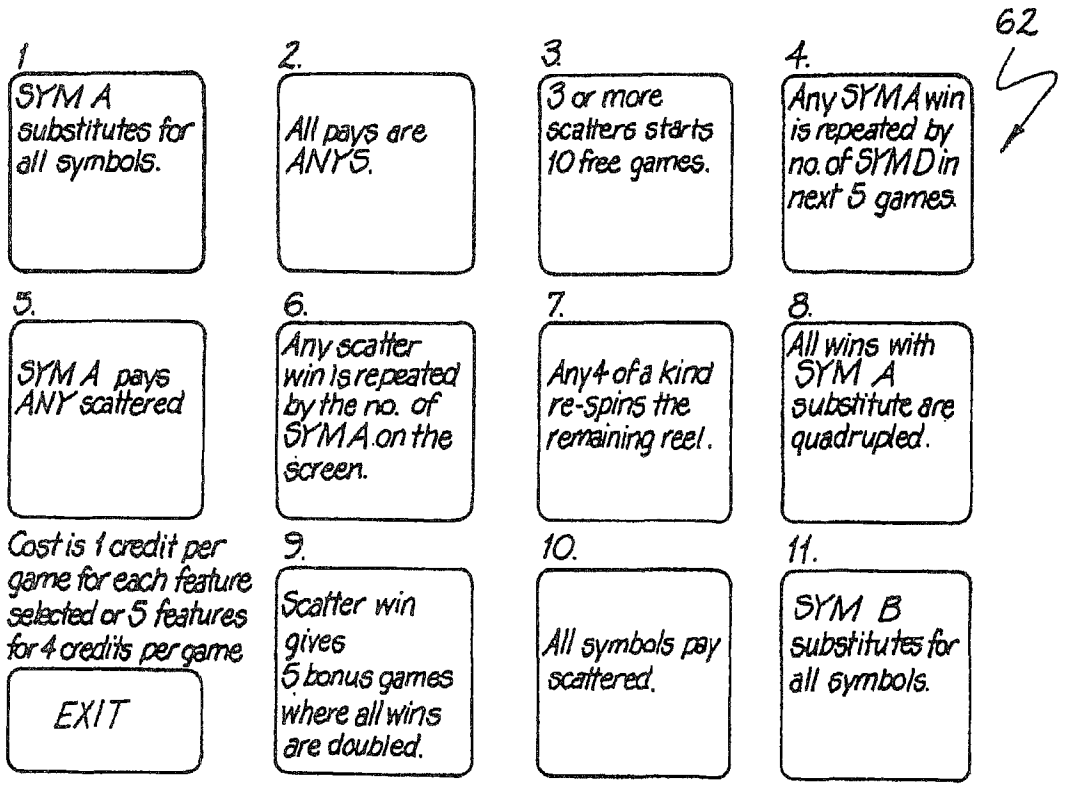
FIG. 7 shows a schematic representation of another embodiment of the third screen of the gaming machine.

To ensure versatility, the player may be given a choice of which features the player wishes to buy. Then, various icons are displayed on the screen as will now be described with reference to FIGS. 4 to 7 of the drawings. In FIG. 4, a basic game screen is shown and is designated generally by the reference numeral 50. The game screen has the usual reels 18 and multi-line pays as indicated by the arrows 52. If the player touches the icon "Prizes" as indicated at 54, a screen 56 shown in FIG. 5 of the drawings is displayed to show what prizes are available to the player. By touching the icon 58 entitled "Features" either a screen 60 as shown in FIG. 6 of the drawings or a screen 62, as shown in. FIG. 7 of the drawings is displayed. The screens 60 and 62 are similar with the difference between the screens being that, in the case of the screen illustrated in FIG. 7 of the drawings, the bet to be made by the player is independent of the type of feature altogether.

The screen in FIG. 6 or 7 allows the players to select the features required. The various icons illustrated as representations of the screens in FIGS. 6 and 7 are largely self explanatory. Suffice to say that a player can select various available options to construct their own games at a cost which that player can afford. The cost may be relative to an aspect of the base bet, i.e. the bet made for the basic game, or independent of the base bet. In addition, the player may be able to nominate the amount they wish to pay for eligibility to a particular feature.

In addition, in this embodiment, various features may be offered by the machine 10 such as, for example, certain combinations of a particular symbol triggering a bonus mode where for the next 10 games each symbol of another type that appears pays a bonus. As a further example, a bought feature could be that a particular symbol acts as a substitute symbol for all other symbols or pays for scattered combinations instead of just on a pay line. Hence, it will be appreciated that a large number of features could be built into the machine 10 to be offered to the players. By the player increasing his or her initial bet, eligibility to the feature is gained.

Figure 8:
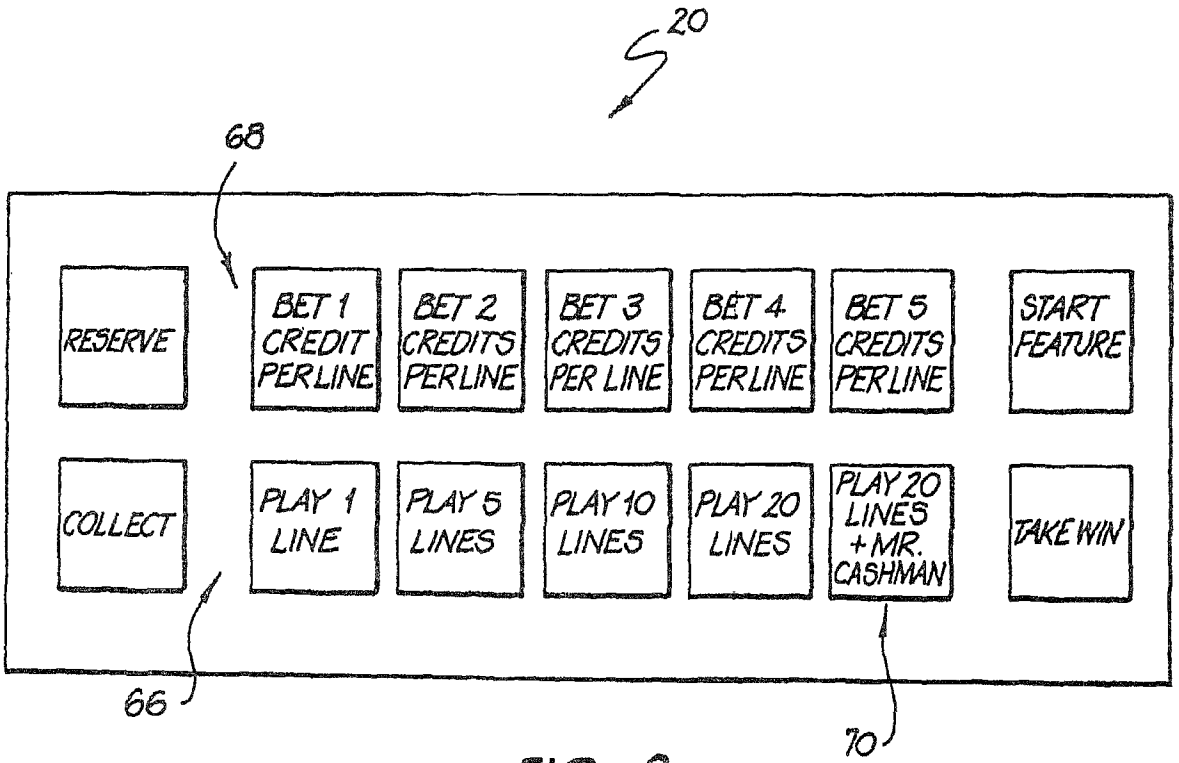
FIG. 8 shows a schematic plan representation of another embodiment of a keypad of the gaming machine.

Referring now to FIG. 8 of the drawings, a keypad 20 in accordance with another embodiment of the invention is illustrated. With reference to FIG. 3 of the drawings, like reference numerals refer to like parts, unless otherwise specified.

In this embodiment of the invention, instead of the buttons 64, a selection button 70 is provided.

Figure 9:
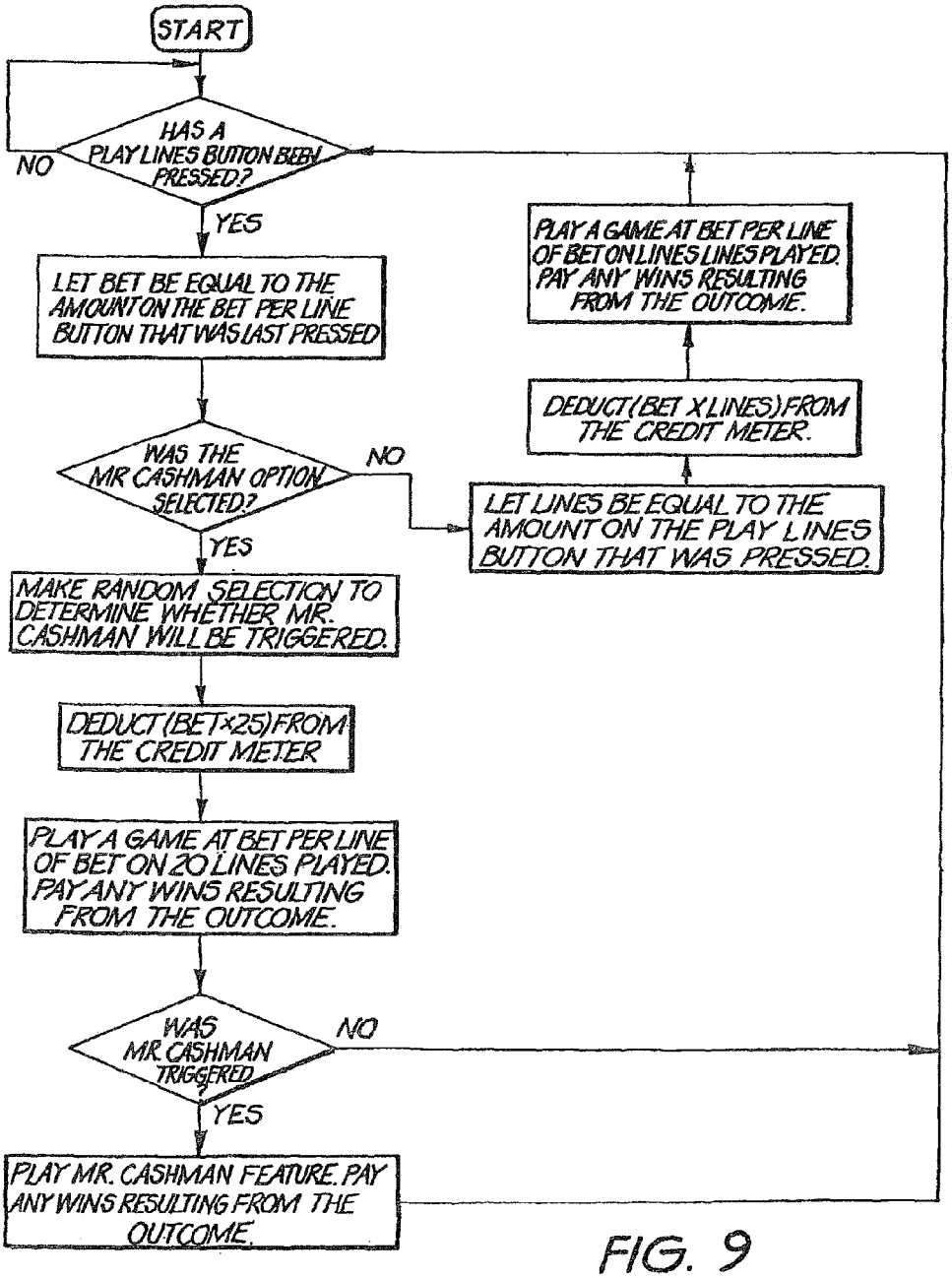
FIG. 9 shows a flow chart of the operation of the embodiment of the invention described with reference to FIG. 8.

In this embodiment of the invention, the player, as illustrated in FIG. 9, is required to make a special bet in order to be eligible for the feature. The feature, in this embodiment is the applicant's Mr Cashman. Mr Cashman is a trademark of the applicant and is described in detail in our co-pending PCT Application Number PCT/AU99/01059 dated 26 Nov. 1999 and entitled "Player information delivery". The contents of PCT/AU99/01059 are specifically incorporated herein by reference. The selection of the Mr Cashman feature is by way of the selection button 70. If the player chooses not to play the Mr Cashman feature, then bets are made in the standard way using the standard buttons 66 and 68.

The Mr Cashman feature is, as illustrated, restricted to the maximum number of lines available for the game configuration. Thus, in the example illustrated, the Mr Cashman feature is provided when the player selects that feature and also elects to play the maximum number of lines being 20 lines. By selecting the feature using the button 70, the player will be eligible to enter the Mr Cashman feature for that game.

The extra cost involved for eligibility to the Mr Cashman feature will be five credits multiplied by the number of credits bet per line. Hence, in the illustrated example, the player must stake 25 credits multiplied by the bet per line in order to be eligible for the Mr. Cashman feature. Once again, the mere wagering of the additional credit does not guarantee that the feature will occur but only that the player is eligible for the feature. The Mr. Cashman feature is not triggered by any trigger condition in the base game. Rather, a random selection is made by the controller 34 completely independently of the base game to determine whether the Mr. Cashman feature is to be triggered or not.

In other words, the player first makes a bet per line using the button 68 and then selects the number of lines to be played using buttons 66 or, where the player desires to include the Mr Cashman feature, the player activates the button 70.

Then, for each game played with the extra feature, the player will have a predetermined probability of triggering the Mr Cashman feature to commence after the base game has been completed.

Accordingly, by means of the invention a more versatile gaming machine 10 is provided which provides players with a greater number of options. In so doing, it is believed that the machines 10 will become more attractive to players.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A gaming machine comprising:

a game controller arranged to facilitate a play of a spinning reel game of chance; and at least one button that allows a player to make a selection of at least one of a plurality of different predefined wager options to thereby identify a selected wager option, the ability of the player to make the selection is independent of any outcome of the spinning reel game of chance, wherein the game controller is arranged to:

award the player a first award that has a value that is proportional to a base wager part of the selected wager option; and provide the player with an opportunity to be awarded a second award if the selected wager option comprises an additional wager part, the opportunity is such that the player is not guaranteed to be awarded the second award and the first award is such that the value of the first award is not proportional to the additional wager part, wherein the plurality of different predefined wager options are arranged such that at least one, but not all, of the plurality of different predefined wager options is associated with the additional wager part.

2. The gaming machine as claimed in claim 1, wherein the game controller is arranged to award the second award to the player independently of any outcome of the spinning reel game of chance.

3. The gaming machine as claimed in claim 1, wherein the game controller is arranged to award the second award to the player in response to a predefined outcome of the spinning reel game of chance.

4. The gaming machine as claimed in claim 1, wherein the second award is one of a plurality of different second awards that the game controller can award to the player.

5. The gaming machine as claimed in claim 1, wherein the selected wager option has a total value that proportional to the base wager part and the additional wager part.

6. The gaming machine as claimed in claim 1, wherein the second award comprises a game.

7. The gaming machine as claimed in claim 1, wherein the game controller is arranged to facilitate a play of a plurality of different games, and wherein the spinning reel game of chance is one of the plurality of different games.

8. The gaming machine as claimed in claim 1, wherein the game controller is arranged to alter an aspect of the spinning reel game of chance to provide the player with the opportunity to be awarded the second award.

9. A method for use by a gaming machine that comprises a game controller arranged to facilitate a play of a spinning reel game of chance; and at least one button that allows a player to make a selection of at least one of a plurality of different predefined wager options to thereby identify a selected wager option, wherein the ability of the player to make the selection is independent of any outcome of the spinning reel game of chance, the method comprising the steps of:

the game controller awarding the player a first award that has a value that is proportional to a base wager part of the selected wager option; and the game controller providing the player with an opportunity to be awarded a second award if the selected wager option comprises an additional wager part, the opportunity is such that the player is not guaranteed to be awarded the second award and the first award is such that the value of the first award is not proportional to the additional wager part, wherein the plurality of different predefined wager options are arranged such that at least one, but not all, of the plurality of different predefined wager options is associated with the additional wager part.

10. The method as claimed in claim 9, wherein the step of the game controller awarding the second award to the player is independent of any outcome of the spinning reel game of chance.

11. The method as claimed in claim 9, wherein the step of the game controller awarding the second award to the player is in response to a predefined outcome of the spinning reel game of chance.

12. The method as claimed in claim 9, wherein the second award is one of a plurality of different second awards that the game controller can award to the player.

13. The method as claimed in claim 9, wherein the selected wager option has a total value that proportional to the base wager part and the additional wager part.

14. The method as claimed in claim 9, wherein the second award comprises a game.

15. The method as claimed in claim 9, wherein the game controller is arranged to facilitate a play of a plurality of different games, and wherein the spinning reel game of chance is one of the plurality of different games.

16. The method as claimed in claim 9, wherein the game controller is arranged to alter an aspect of the spinning reel game of chance to provide the player with the opportunity to be awarded the second award.

* * * * *